United States Patent [19]

Marulic et al.

[11] 4,417,526

[45] Nov. 29, 1983

[54] GONDOLA CAR CONSTRUCTION

[75] Inventors: Walter J. Marulic, Dunwoody; Kent N. Johnson, Atlanta, both of Ga.

[73] Assignee: United-American Car Co., Atlanta, Ga.

[21] Appl. No.: 275,610

[22] Filed: Jun. 22, 1981

[51] Int. Cl.[3] ..... B61D 3/08; B61D 17/08; B61D 49/00

[52] U.S. Cl. ..... 105/406 R; 105/409

[58] Field of Search ..... 105/406 A, 406 R, 409, 105/410

[56] References Cited

U.S. PATENT DOCUMENTS

| | | | |
|---|---|---|---|
| 1,838,006 | 12/1931 | Small | 105/406 R |
| 2,054,783 | 9/1936 | Gilpin | 105/409 |
| 2,075,195 | 3/1937 | Gilpin | 105/409 |
| 2,382,519 | 8/1945 | Swann | 105/409 |
| 2,602,405 | 7/1952 | Johansson | 105/409 |
| 2,859,709 | 11/1958 | Flowers | 105/406 R X |

*Primary Examiner*—Bruce H. Stoner, Jr.
*Assistant Examiner*—Howard Beltran
*Attorney, Agent, or Firm*—Shlesinger, Arkwright, Garvey & Fado

[57] ABSTRACT

A railroad gondola car comprising a subframe assembly including a side sill channel member, a floor sheet, a side assembly including a side sheet and a plurality of side posts secured to the side sheet, the side posts comprising channel or hat shaped members opening toward the side sheet, a longitudinally extending angle member secured to the side sheet on the opposite side of the side sheet from the side posts and adjacent the lower edge of the side sheet, a structural reaction plate secured to the side posts within the channel or hat shaped cross section thereof and extending outwardly of the channel preferably a distance at least as great as the thickness of the side sheet, and being secured to the angle member, the side posts extending below the side sheet and being secured to the side sill channel member, and the angle member being secured to the subframe assembly or floor sheet.

21 Claims, 10 Drawing Figures

GONDOLA CAR CONSTRUCTION

This invention relates to a railroad gondola car, and particularly an improved railroad gondola car having enhanced lateral load strength, especially in the area of the connection between the side walls of the car and the subframe, and an improved technique for making the gondola car.

BACKGROUND OF THE INVENTION

A number of different types of railroad cars are available, particularly categorized according to the type of cargo for which they are intended. The type of cargo dictates a number of requirements such as cubic foot capacity, floor strength, side wall strength, covered or uncovered, and so forth.

Gondola cars are typically open or uncovered vehicles and are used to carry a large variety of industrial cargo. But even within the category of gondola cars, several different types are available, again depending upon the type of cargo to be handled. Specifically, some gondola cars are designed to carry wood chips and similar products of relatively low density, while other gondola cars carry such products as coal which is of relatively higher density. So called "mill" gondola cars are commonly used around steel mills and are intended for carrying such cargos as steel scrap, slag, or steel sheet. With regard to steel sheet, quite often the sheet may be wider than the gondola car, and would therefore be loaded into the gondola car diagonally, i.e. extending from one lower corner of the car to the opposite upper corner of the car. Mill gondola cars, therefore, require a very high lateral load strength.

Experience has shown that mill gondola cars are subject to extreme abuse, with most typical structural failures occurring at the connection of the side to the underframe at the side post interface. Analysis of various car constructions has confirmed that the connection of the side post and the underframe was one of the most critical areas of the car.

Typically such gondola cars are constructed in stages wherein the subframe and floor assembly is first made, and the side assembly is separately made. The side assembly includes a number of vertical channel or hat-shaped posts for reinforcing the side, and these assemblies are attached to the subframe assembly, with the side posts being either bolted or welded to the subframe assembly. Since no internal lateral reinforcement is usually used in a mill gondola car, lateral loads on the side walls of the car tend to tear the side posts away from the subframe assembly.

The present invention seeks to overcome this area of weakness of such gondola cars.

BRIEF DESCRIPTION AND OBJECTS OF THE INVENTION

According to the present invention, a reinforcement member in the nature of a structural reaction plate is connected to the side posts and is secured to an internal reinforcement of the side assembly which in turn is connected to the subframe assembly. The structural reaction plate greatly increases the degree of connection between the side posts and the entire side assembly and the subframe assembly, at the juncture of the side posts and the subframe, thereby greatly enhancing the strength of the gondola car in this area. The structural reaction plate arrangement adds only slightly to the cost of such a vehicle and yet greatly enhances the strength and thus extends the useful life of the vehicle.

Accordingly, it is a primary object of this invention to provide a gondola car construction of improved lateral load strength without need for mechanical fastening or other expensive and elaborate fastening means.

Another object of this invention is to provide a gondola car construction of improved strength in the area of the side post of subframe connection.

A further object of the invention is to provide a gondola car construction which utilizes a structural reaction plate in association with the vertical side posts for improving the lateral load strength of the vehicle.

Still a further object of this invention is to provide a mill gondola car of greatly improved strength at minimal cost.

DESCRIPTION OF THE DRAWINGS

These and other objects and advantages of this invention will become apparent when considered in light of the following specification and claims, particularly when taken with the accompanying drawings in which:

DETAILED DESCRIPTION OF THE INVENTION

Figure 1:
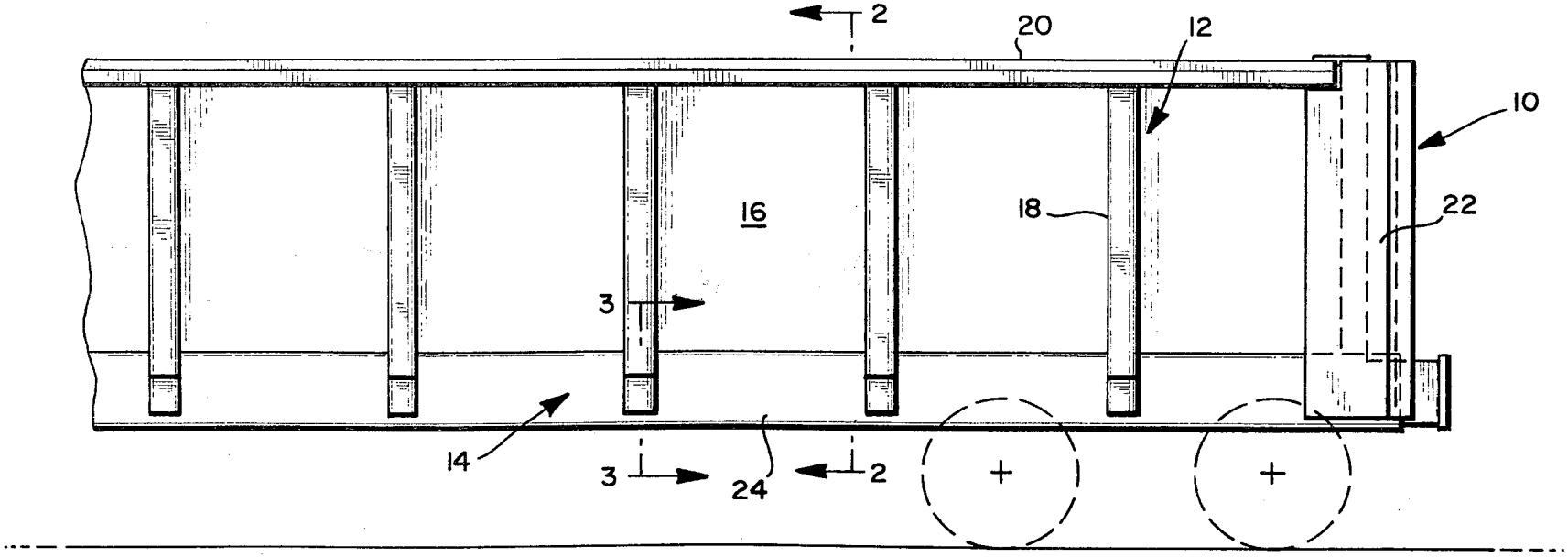
FIG. 1 is a fragmentary side elevation view of a gondola car according to the present invention.

Referring first to FIG. 1, a gondola car generally designated 10 is seen to include a side frame assembly 12 and a subframe assembly 14. The side frame assembly 12 includes a side sheet 16 which extend the full length of the car and is of an appropriate height.

The side frame assembly 12 also includes a plurality of vertical side posts 18, a side plate 20, angle members 30 and corner posts 22.

Figure 2:
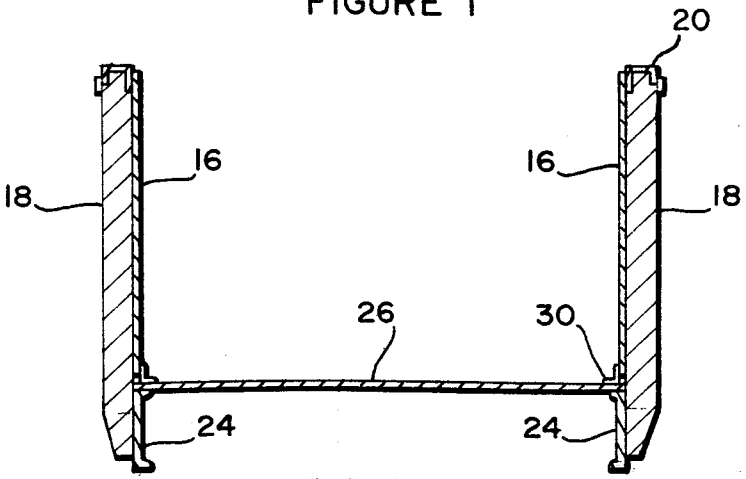
FIG. 2 is a cross sectional view along lines 2—2 of FIG. 1 and viewed in the direction of the arrows.

The subframe assembly includes a side sill member 24 on each lateral side of the car, and also includes conventional cross ties, stringers, bolsters, and truck mounting members (not shown) of conventional construction. The side sill member 24 is preferably a channel shaped member although other configurations such as box, or similar such variations may be used. A floor plate 26 is also provided as seen in FIG. 2. The construction details of the components thus far mentioned is substantially conventional.

Figure 3:
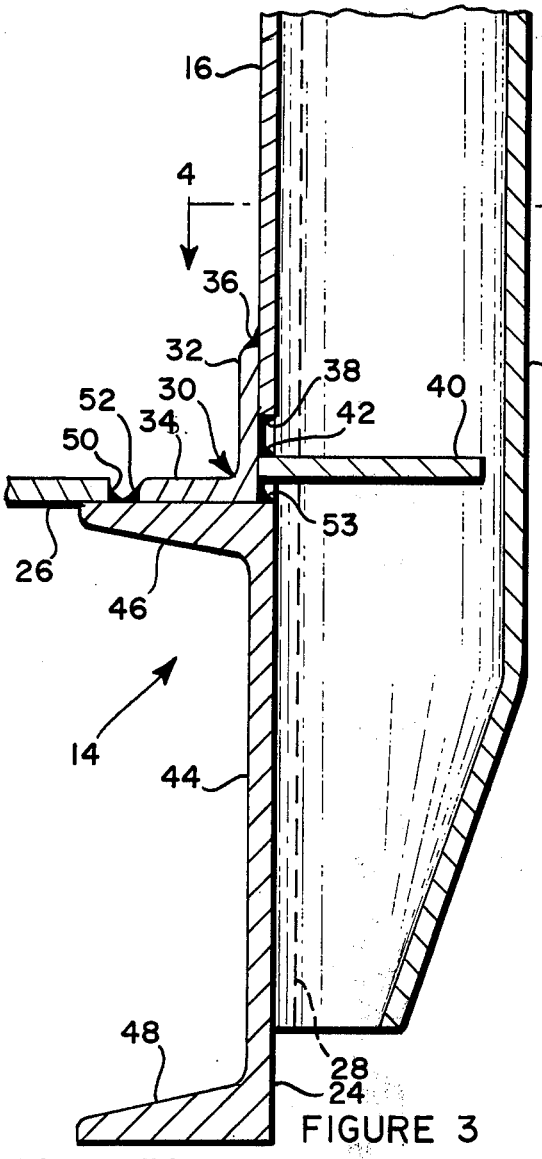
FIG. 3 is an enlarged sectional view along lines 3—3 of FIG. 1 and viewed in the direction of the arrows.
Figure 4:
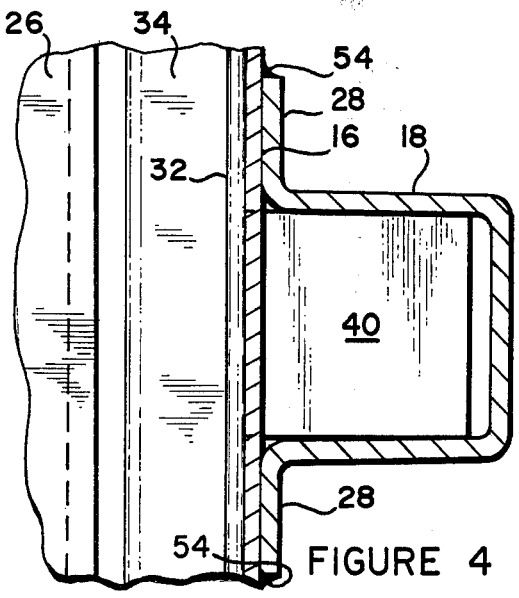
FIG. 4 is a cross sectional view along lines 4—4 of FIG. 3 and viewed in the direction of the arrows.

Referring now to FIGS. 3 and 4, the side posts 18 are seen to be channel members which may be provided with flanges 28 as shown, if desired, as a hat-shaped configuration. The side frame assembly also includes an angle member 30 having a vertical segment 32 and a horizonal segment 34. Alternatively, an angle member having a right-triangular, square, or rectangular cross-section may be used in place of the right angle member 30 shown. The angle member 30 is positioned so that at least a portion of the vertical segment overlaps the bottom of the side sheet 16 and the angle member 30 extends and is secured along the full length of the side sheet 16 as by welds 36 and generally intermittently by welds 38.

A structural reaction plate member 40 is positioned within the channel of each vertical side post 18 as shown, and is ultimately secured to the channel as by welding or bolting. In addition, the structural reaction plate 40 extends beneath the lower edge of side sheet 16 and is secured to vertical segment 32 of the angle member 30 as, for example, by weld 42.

As shown, the side sill channel member 24 includes a vertical web portion 44, an upper horizontal web portion 46 and a lower horizontal web portion 48. As indicated previously, the subframe assembly includes the conventional cross ties and stringers (not shown) which are suitably connected to the side sill channel 24 in a conventional manner. In the embodiment of FIGS. 3 and 4, the floor plate 26 is suitably attached to the upper horizontal web 46 of the side sill channel 24, as for example by weld 50. It should be pointed out that a particular advantage of the present invention permits placement and attachment of the floor plate 26 before the side frame assembly is secured to the subframe assembly.

In the preferred manufacturing technique, firstly the side posts 18, side sheet 16, and side plate 20 are fabricated, and likewise the angle member 30 is fabricated with the reaction plates 40 welded onto the angle member 30, as by welds 42 at the proper position. The side posts, side sheet, side plate and angle member with attached reaction plates are then placed into a building fixture in their proper relative positions. The side posts 18 are then placed on the side sheet 16 indexing the side posts over the reaction plates 40. In this manner, the reaction plates help to position the side posts on the assembly. At this point, the side assembly is welded from the post side thereof, and the side assembly is turned over and welds are made on the inside of the side posts 18 to the reaction plates 40 along the bottom side of the reaction plates.

The subframe assembly is typically made as a separate subassembly with the floor plate attached. The side assembly and subframe assembly are then positioned in their proper relative locations and a continuous weld 52 is made between the angle member 34 and the horizontal section 46 of the side sill channel 44, as well as weld 53 which is discontinuous along the length of the angle member 30, between side posts 18. Weld 54 between the side posts 18 and side sill channel member 44 completes the assembly.

The structural reaction plate 40 thereby provides greatly enhanced strength in the area of the connection of the side frame assembly to the subframe assembly, particularly to resist breaking of the side posts 18 away from the side sill channel 24. Reaction plate 40 need not extend the full depth of the posts 18 to achieve the additional strength, as shown in FIG. 4.

Figure 5:
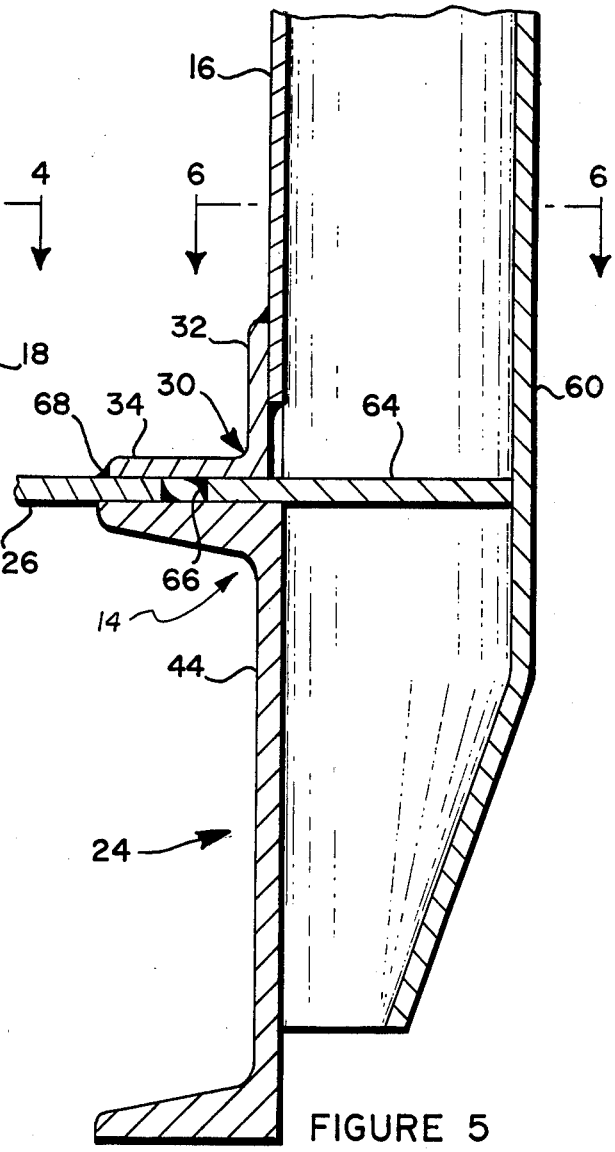
FIG. 5 is a cross sectional view similar to FIG. 3 of another embodiment.
Figure 6:
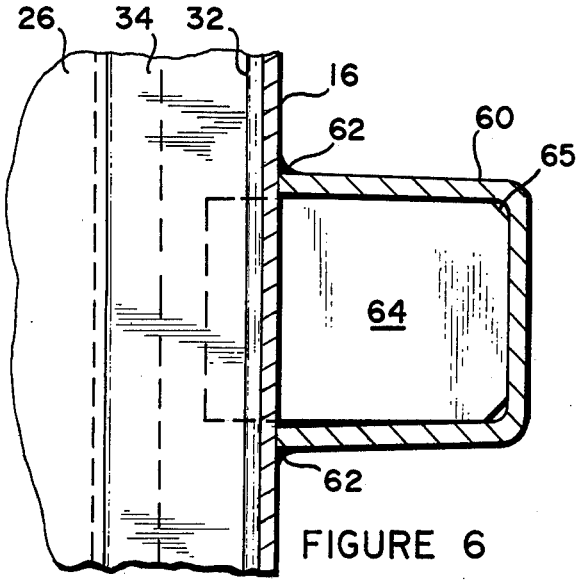
FIG. 6 is a cross sectional view along lines 6—6 of FIG. 5 and viewed in the direction of the arrows.

In an alternate embodiment illustrated in FIGS. 5 and 6, like reference numerals have been used to illustrate like part as in the previous example.

In this embodiment, a slightly different side post 60 is used which does not have the flanged 28, but instead is attached directly to the side sheet 16 and side sill 24 as for example by weld 62. Of course flanged side posts may be used. The structural reaction plate 64 is of slightly greater length than in the previous embodiment and extends beneath the angle member 20, and is welded or otherwise attached to the underside of the horizontal segment 34 as by weld 66. The structural reaction plate 64 is then essentially coplanar with the floor plate 26 as shown, and when the side frame assembly is attached to the subframe assembly, the angle member 30 is then attached to the subframe assembly as by bloting or by weld 68 to the floor plate. Again, the sides of the side posts 60 are attached to the vertical web 44 of the side sill channel 24 as for example by welding at the juncture. In FIG. 6, the reaction plate 64 is also seen to extend the full depth of the posts 60 as may be desirable in some applications, and in such case, corner bevels 65 will facilitate assembly.

In come circumstances, it may be desirable to provide a gondola car having "rounded" corners at the juncture of the floor and the side wall. When this is the case, the embodiment of FIGS. 7 and 8 is advantageous for providing the improved structural strength according to the present invention.

In this embodiment, the side posts 70, which are shown to have flanged 72, may also be unflanged as in the embodiment of FIGS. 5 and 6. Here, the structural reaction plate 74 is attached to the vertical segment 32 of the angle member 30 as by weld 76. In this embodiment, the side assembly is attached to the subframe assembly, and particularly the side sill channel 24, before placement of the floor plate 82, and is secured by bolting or by weld 78. Again, the side posts 70 are secured to the vertical web 44 of the side sill channel 24 as for example by welds 80. After the side frame assembly has been thus joined to the subframe assembly, the floor plate may be attached. Floor plate 82 is seen to be seated on flange 34 and to have an upturned lateral edge portion or flange 84 which is attached to the vertical segment 32 of the angle member 30 for example by weld 86.

Figure 7:
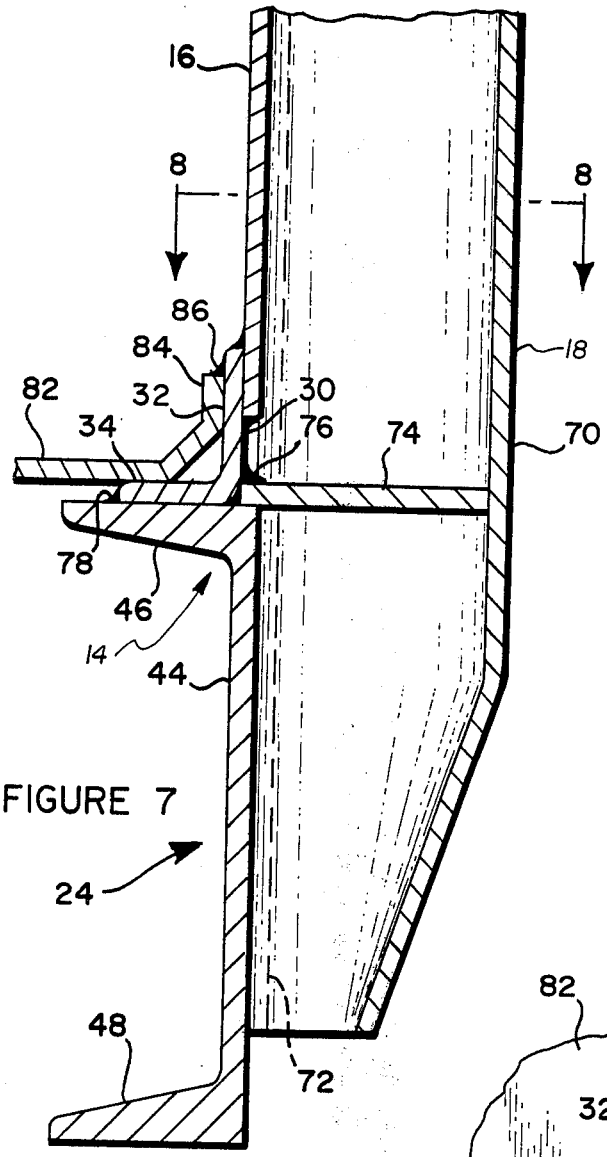
FIG. 7 is a cross sectional view similar to FIG. 3 of still another embodiment of this invention.
Figure 9:
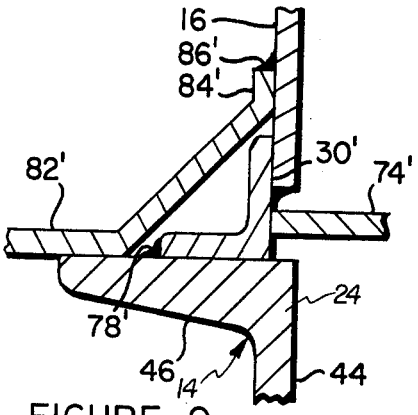
FIGS. 9 and 10 are fragmentary cross sectional views of still further embodiments of the invention.
Figure 10:
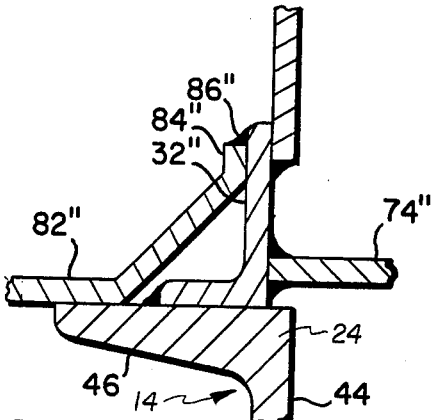
Figure 8:
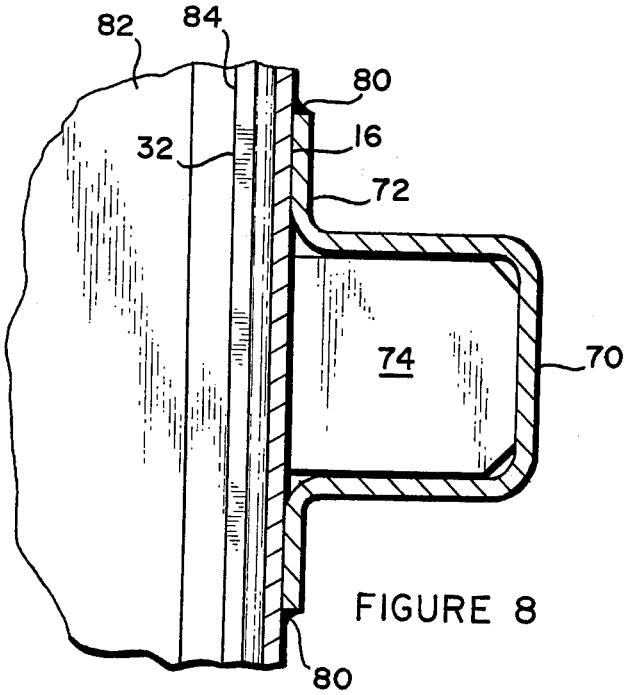
FIG. 8 is a cross sectional view along lins 8—8 of FIG. 7 and viewed in the direction of the arrows.

FIGS. 9 and 10 show still further variations on the embodiment of FIGS. 7 and 8, particularly at the area of the floor connection. Thus in FIG. 9, the floor 82' is seated on horizontal section 46 of channel member 24 and has an upturned flange portion 84' which extends to the side sheet 16 and is attached thereto by bolting or by weld 86'. The angle member 30' is secured to the top flange 46 of the side sill channel member 44 as for example by weld 78'.

FIG. 10 is similar to FIG. 9, however the upturned flange portion 84'' of the floor sheet 82'' is attached to the vertical web 32'' by weld 86'', and the floor sheet 82'' again rests directly on the horizontal web 46 of the side sill channel 44. The structural reaction plate 74' is also attached to the vertical web 32'' by welding.

It should be noted that the vertical positioning of the reaction plates 74, 74' or 74'' along the vertical webs 32, 32' and 32'' of the angle members 30, 30' and 30'' is not especially critical, however slightly improved strength is obtained with a greater lap of the side sheet 16 over the angle member which in turn positions the structural reaction plate closer to the corner of the angle member. It should also be noted that the lower edge of the side sheet 16 may be a straight edge along the length of the car, or alternatively could be notched to receive the reaction plates, in the area of the posts, and abut the top surface of the vertical web portion 46 in the area between the side posts.

In each of the embodiments, construction of the side assembly is facilitated as described previously, particularly in the placement of the side posts over the reaction plates which have been previously attached to the angle member. After the reaction plates are welded to the vertical posts, which may be easily accomplished before the side assembly is attached to the subframe assembly, the side assembly is easily and securely attached to the subframe assembly.

In each of the foregoing embodiments, it is seen that the structural reaction plates 40, 64, 74, 74' or 74'' provide significantly improved strength in the area of the connection of the side posts to the side sill channel, without interfering with conventional configurations. Similar arrangements may be adopted for other gondola car configurations within the scope of this invention.

While this invention has been described as having a preferred design, it will be understood that it is capable of further modification. This application, is therefore, intended to cover any variations, uses, or adaptations of the invention following the general principles thereof and including such deparatures from the present disclosure as come within known or customary practice in the art to which this invention pertains, and as may be applied to the essential features hereinbefore set forth and fall within the scope of this invention or the limits of the claims.

What is claimed is:

1. A railroad gondola car comprising:

a subframe assembly including a side sill channel member, a side structure including a side sheet having inner and outer surfaces and a plurality of vertical side posts secured to said outer surface of said side sheet, said side posts comprising channel-shaped members wherein the channel opens toward said side sheet, a longitudinally extending angle member secured to said side sheet surface and adjacent the lower edge of said side sheet, a structural reaction plate member transverse of said side post secured to said side posts within the channel thereof and having one end extending outwardly of the channel a distance at least as great as the thickness of said side sheet, and said structural reaction plate member being secured to said angle member and said outwardly extending end of said structural reaction plate member being adjacent said side sill channel member, and said side posts extending below said side sheet and being secured to said side sill channel member and said angle member being secured to said subframe assembly.

2. A railroad gondola car as in claim 1 and wherein said angle member is secured to said side sill channel member.

3. A railroad gondola car as in claim 2 and wherein said subframe assembly includes a floor plate secured to said side sill channel member.

4. A railroad gondola car as in claim 3 and wherein:

said side sill channel member comprises a vertical web portion and an upper horizontal web portion, said side posts being secured to said vertical web portion and said angle member being secured to said upper horizontal web portion.

5. A railroad gondola car as in claim 4 and wherein said angle member includes a vertical segment secured to said side sheet and a horizontal segment secured to said upper horizontal web portion.

6. A railroad gondola car as in claim 5 and wherein said floor plate is secured to said upper horizontal web portion.

7. A railroad gondola car as in claim 6 and wherein said floor plate and said horizontal segment are coplanar and are parallel to said upper horizontal web portion.

8. A railroad gondola car as in claim 2 and wherein:

said angle member includes a vertical segment secured to said side sheet and a horizontal segment secured to said side sill channel member, said subframe assembly including a floor plate having a longitudinally extending lateral upturned flange portion, said floor plate being positioned on said horizontal segment and said flange portion being secured to said vertical segment.

9. A railroad gondola car as in claim 7 or 8 and wherein said vertical segment extends above the lower edge of said side sheet.

10. A railroad gondola car as in claim 9 and wherein said structural reaction plate is secured to said vertical segment.

11. A railroad gondola car as in claim 10 and wherein said structural reaction plate is welded to said vertical segment, said vertical segment is welded to said side sheet, and said horizontal segment is welded to said upper horizontal web.

12. A railroad gondola car as in claim 11 and wherein said side posts are welded to said side sheet, said structural reaction plate and said vertical web portion.

13. A railroad gondola car as in claim 5 and wherein said side posts have outwardly turned flanges.

14. A railroad gondola car as in claim 1 and wherein:

said side sill channel member comprises a vertical web portion and an upper horizontal web portion, said side posts being secured to said vertical web portion.

15. A railroad gondola car as in claim 14 and wherein said subframe includes a floor plate secured to said upper horizontal web portion.

16. A railroad gondola car as in claim 15 and wherein said angle member includes a vertical segment secured to said side sheet and a horizontal segment secured to said floor plate.

17. A railroad gondola car as in claim 16 and wherein said structural reaction plate is secured to said horizontal segment and is sandwiched between said horizontal segment and said upper horizontal web portion.

18. A railroad gondola car as in claim 5 and wherein said floor plate includes an upturned lateral edge portion.

19. A railroad gondola car as in claim 18 and wherein said floor plate is positioned on said upper horizontal web portion.

20. A railroad gondola car as in claim 19 and wherein said edge portion is secured to said side sheet.

21. A railroad gondola car as in claim 19 and wherein said edge portion is secured to said vertical segment.

* * * * *